US006237764B1

(12) United States Patent
Kastelic

(10) Patent No.: US 6,237,764 B1
(45) Date of Patent: May 29, 2001

(54) SPORTING EQUIPMENT BAG

(75) Inventor: Rudy Kastelic, Chagrin Falls, OH (US)

(73) Assignee: Kastelic Promotions, Inc., Garfield Heights, OH (US)

( * ) Notice: Subject to any disclaimer, the term of this patent is extended or adjusted under 35 U.S.C. 154(b) by 0 days.

(21) Appl. No.: 09/527,738

(22) Filed: Mar. 17, 2000

(51) Int. Cl.[7] ..... B65D 85/20

(52) U.S. Cl. ..... 206/315.1; 190/103; 190/15.1; 383/4

(58) Field of Search ..... 206/315.1, 315.9, 206/315.91; 190/15.1, 103, 104, 109, 112, 903, 115; 383/4, 38

(56) References Cited

U.S. PATENT DOCUMENTS

| | | | |
|---|---|---|---|
| 1,895,744 | | 1/1933 | Arnold . |
| 1,976,698 | | 10/1934 | Gihon . |
| 2,394,332 | | 2/1946 | Salem . |
| 3,957,141 | | 5/1976 | Domes . |
| 4,171,011 | | 10/1979 | Kopin . |
| 4,236,615 | | 12/1980 | Ginat . |
| 4,613,039 | | 9/1986 | Shaw et al. . |
| 4,693,402 | | 9/1987 | Comeau . |
| 4,746,159 | | 5/1988 | Webb et al. . |
| 4,805,748 | | 2/1989 | Gerch . |
| 4,830,154 | | 5/1989 | Gerch et al. . |
| 5,012,921 | * | 5/1991 | Becker ..... 206/315.1 |
| 5,042,664 | | 8/1991 | Shyr et al. . |
| 5,159,999 | | 11/1992 | Voigt . |
| 5,356,002 | | 10/1994 | Brown . |
| 5,497,919 | | 3/1996 | Klinger . |
| 5,588,529 | | 12/1996 | Speck . |
| 5,692,660 | | 12/1997 | Stewart . |
| 6,015,072 | * | 1/2000 | Young ..... 190/103 |

FOREIGN PATENT DOCUMENTS

| | | |
|---|---|---|
| 38409/93 | 8/1993 | (AU) . |
| 2 244 210 | 11/1991 | (GB) . |

* cited by examiner

*Primary Examiner*—Paul T. Sewell
*Assistant Examiner*—Shian Luong
(74) *Attorney, Agent, or Firm*—Fay, Sharpe, Fagan, Minnich & McKee, LLP

(57) ABSTRACT

A sporting equipment bag including a body having a first compartment, a first end, a second end, a third end and a fourth end. The bag also includes a second compartment which is located adjacent the first compartment, the second compartment has a first, open end and a second, sealed end. The first, open end extends beyond the body and is folded into the second compartment into a folded, stored position. The first, open end provides access to the second compartment separate from the first compartment. A pair of hook and loop fasteners are attached to the second compartment to secure it in a folded, stored position. An extendable portion extends between the body and the first open end to receive a rod-shaped object and is telescoped within the second compartment into a folded, stored position.

11 Claims, 4 Drawing Sheets

FIG. 1A
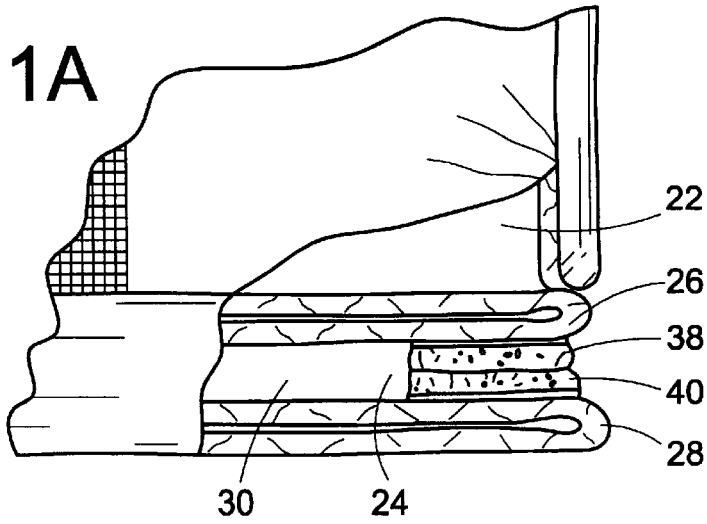
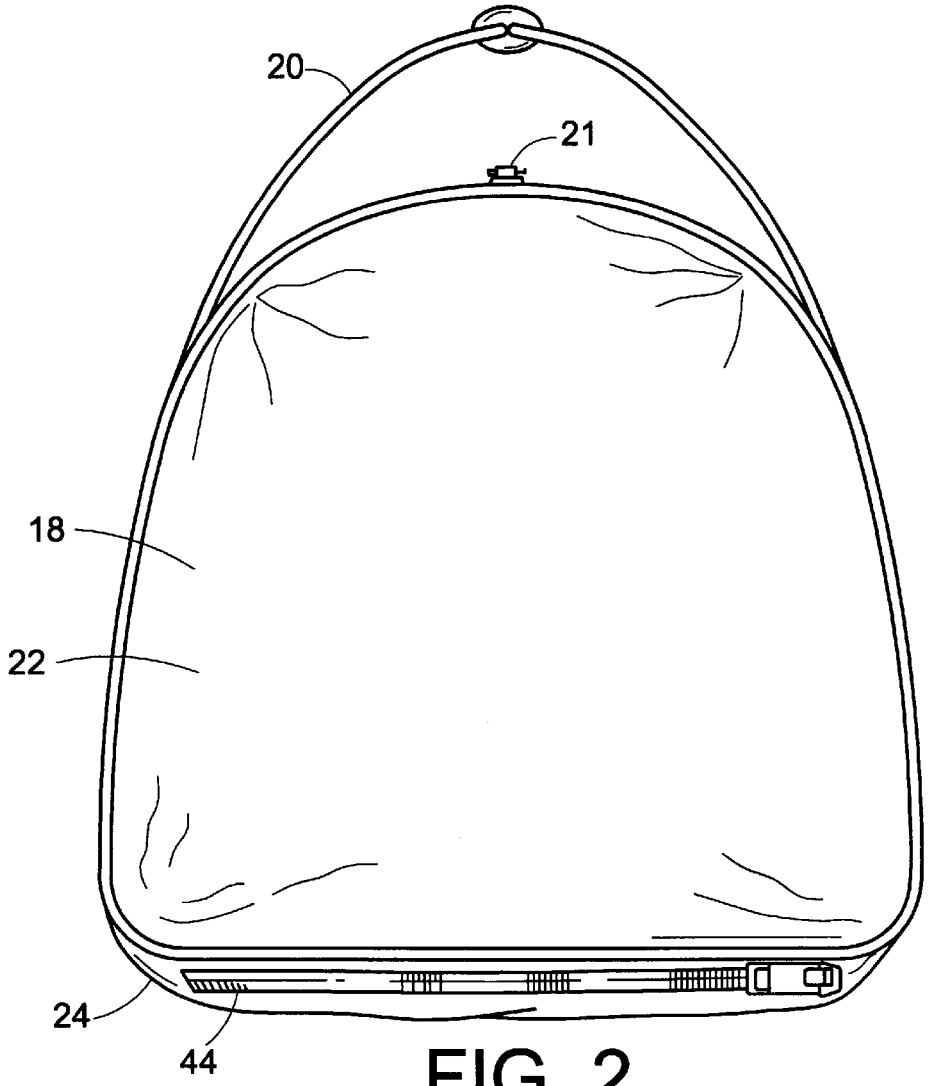
FIG. 2

SPORTING EQUIPMENT BAG

BACKGROUND OF THE INVENTION

The present invention relates generally to sporting equipment bags. More particularly, it relates to an improved sporting equipment bag for carrying baseball bats or softball bats and other sports related equipment.

It is well known to both the casual weekend athlete and the professional player that one of the most unpleasant tasks associated with playing baseball/softball is transporting all necessary equipment to and from the ball field. A non-exhaustive list of desired equipment includes a baseball glove, a batting glove, baseballs, athletic shoes (i.e., cleats or spikes), a water bottle, a score book and a helmet.

More recently, sport utility bags have become available which comprise separate compartments in which certain items can be stored. However, these bags still are difficult to clean and also hold many heavier items (such as bats) loosely, which makes the bag more difficult to carry and more likely to cause damage to other, lighter items contained in the bag.

Baseball equipment bags have become more sophisticated with time. The early bags were typically an elongated duffel or toll-type bag having a zippered opening and an elongated storage compartment for storing the player's equipment. This type of bag is popular because of its soft-sided feature which makes it easy to store and transport. The player's equipment typically includes at a minimum a bat, a ball glove, one or more balls, a cap, and playing shoes. Additionally, it may be desirable to carry the player's shirt, pants and a towel in the bag for convenience. Thus, a variety of items may typically be carried in the player's bag. The plain elongated duffel or roll-type bag with one elongated compartment fails to keep the various items in any semblance of organization in the equipment bag making it difficult for the player to keep items segregated and inconvenient for the player to find things within the bag.

The problems associated with segregating the items and finding things within the bag have been partially resolved by including pouches and/or pockets attached to the inside and/or outside of the bag. Typically, the pouches or pockets have an opening which closes by means of a zipper, elastic or VELCRO hook and loop fasteners. VELCRO is a registered trademark of Velcro Industries B.V. The present baseball equipment bags typically include a segregated and separate bat compartment for housing one or more bats with access to the bats being provided solely by means of a zippered bat opening.

However, many of these bags are of a larger size to accommodate the length of a baseball bat or softball bat, thus making them bulky and inconvenient to use when not storing a bat inside them. Other bags have a portion which extends to accommodate a bat but is not accessible from the exterior of the bag. The bat must be installed through the main compartment of the bag. Also, some bags have extendable compartments which cannot be folded or stored within the bag.

Thus, it is considered desirable to have a sporting equipment bag which has an extendable compartment to accommodate a bat and has an opening separate from the remainder of the bag. It is also considered desirable to have a sporting equipment bag with an extendable portion which may be folded or telescoped into a portion of the bag and sealed closed.

Accordingly, it has been considered desirable to develop a new and improved sporting equipment bag which would overcome the foregoing difficulties and others while providing better and more advantageous overall results.

BRIEF SUMMARY OF THE INVENTION

The present invention relates to a sporting equipment bag. More specifically, the sporting equipment bag is used for carrying and transporting baseball bats, softball bats, as well as other sports related equipment such as balls, gloves, clothing, etc.

The sporting equipment bag includes a body having a first compartment, a first end, a second end, a third end and a fourth end. The first end and the second end are opposite to and generally parallel to each other. The third end and the fourth end are opposite to and generally parallel to each other. The first compartment is formed between the first end, second end, third end, and fourth end.

The sporting equipment bag further includes a second compartment located adjacent the first compartment. The second compartment has a first, open, end and a second, sealed, end. The first, open, end and the second, sealed, end are located opposite each other. The first, open, end extends beyond the body and is folded into the second compartment into a folded, stored position. The first, open, end provides access to the second compartment separate from the first compartment.

The sporting equipment bag further includes a handle attached to the body first end. The sporting equipment bag further includes a pair of hook and loop fasteners attached to the second compartment. The hook and loop fasteners secure the second compartment in a folded, stored position.

The second compartment also includes an extendable portion which extends between the body and the first open end to receive a rod-shaped object and is telescoped within the second compartment into a folded, stored position. The extendable portion is sealed closed by a zipper or other sealing device.

The second compartment can further include a first portion and a second portion. The first portion and the second portion form the extendable portion. The first portion separates the second compartment from the first compartment.

One advantage of the present invention is the provision of a sporting equipment bag which has two separate compartments, one for bats and the other for other equipment.

Another advantage of the present invention is the provision of a sporting equipment bag which has an extendable compartment which can accommodate a baseball bat or softball bat.

Still another advantage of the present invention is the provision of a sporting equipment bag which has an extendable compartment which can be folded into the second compartment and secured closed by hook and loop fasteners.

Yet another advantage of the present invention is the provision of a sporting equipment bag which has an extendable compartment with a zippered outer opening which allows access to the extendable compartment from the exterior of the bag.

Still other benefits and advantages of the present invention will become apparent to those skilled in the art upon a reading and understanding of the following detailed description.

BRIEF DESCRIPTION OF THE DRAWINGS

The invention may take form in certain parts and arrangements of parts, a preferred embodiment of which will be described in detail in this specification and illustrated in the accompanying drawings which form a part hereof and wherein:

FIG. 1A is an enlarged cross-sectional view of the extendable portion of the sporting equipment bag in the stored position;

FIG. 2 is a side elevational view of the sporting equipment bag of FIG. 1 with the extendable portion in the stored and zipped closed position;

DETAILED DESCRIPTION OF THE PREFERRED EMBODIMENT

Figure 1:
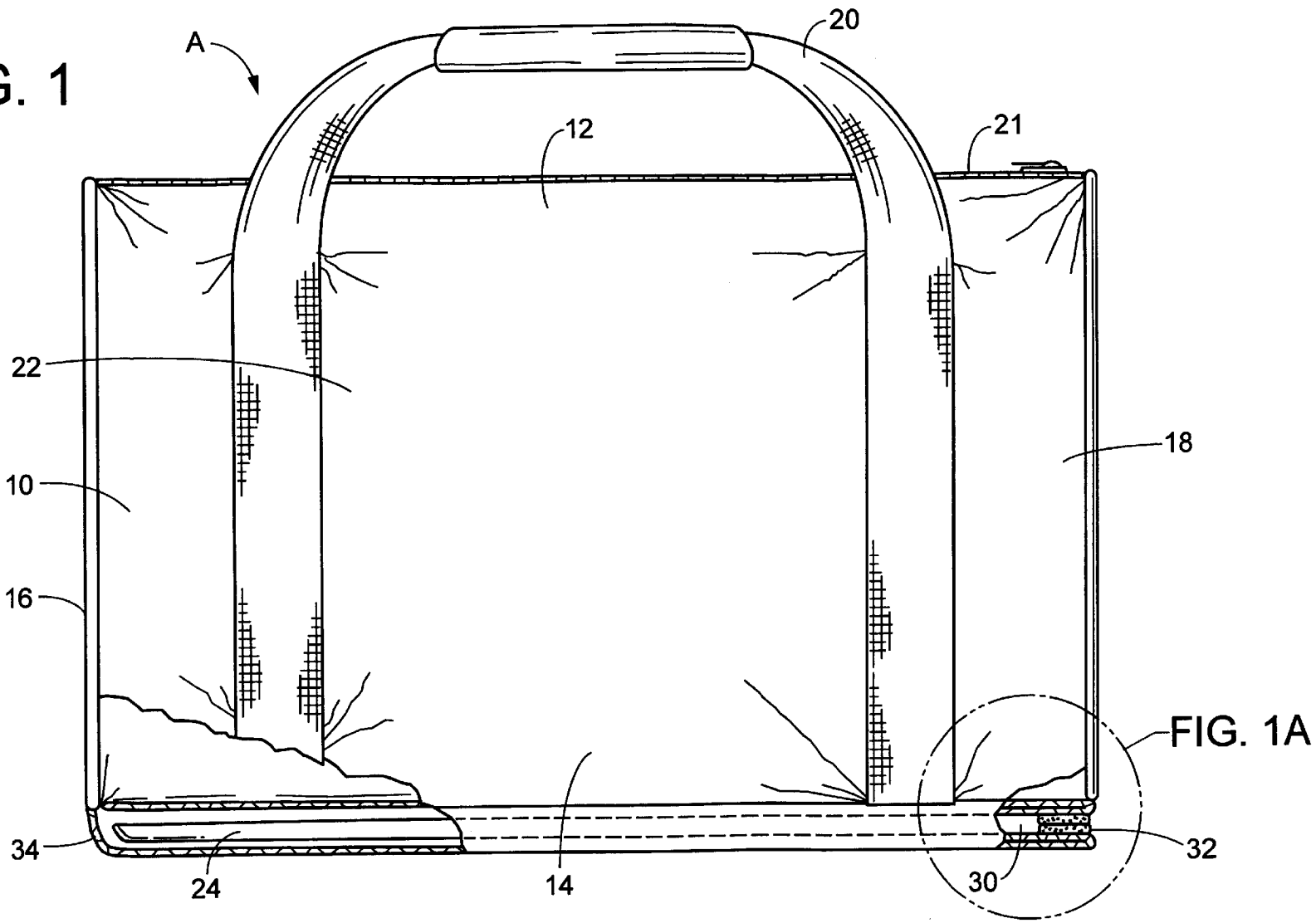
FIG. 1 is a side elevational view of the sporting equipment bag in accordance with the preferred embodiment of the present invention with the extendable portion in the stored position.

Referring now to the drawings, wherein the showings are for purposes of illustrating preferred embodiments of this invention only, and not for purposes of limiting same, FIG. 1 shows a sporting equipment bag A in accordance with the preferred embodiment of the present invention. The sporting equipment bag comprises a body 10 which has a first end 12, a second end 14, a third end 16, and a fourth end 18. The first end 12 is opposite to and generally parallel with the second end 14. The third end 16 is opposite to and generally parallel with the fourth end 18. A handle 20 is fixedly attached to the first end 12. The handle 20 may be sewn or stitched or otherwise secured to the body 10 of the bag. The bag may be fabricated from flexible material, such as nylon or other durable material. A zipper 21 or other sealing device is provided at the first end 12 of the bag. The zipper 21 provides access to the first compartment 22. The bag is collapsible into a flattened configuration (not shown).

The bag further includes a first, or main, compartment 22. The first compartment 22 is used to carry various types of sporting equipment, such as balls, gloves, clothing, hats, etc. The walls of the first, or main, compartment 22 are formed between the first end 12, the second end 14, the third end 16, and the fourth end 18. The bag also includes a second compartment 24, which is adjacent to and separate from the first compartment 22. The second compartment 24 is shown in FIG. 1 to be located below the first compartment 22, but the second compartment 24 could be located above the first compartment 22 as well. The second compartment 24 is generally parallel to the first compartment 22. The second compartment 24 is used for the storage of baseball bats or softball bats.

Referring to FIG. 1A, the second compartment 24 includes a first portion 26 and a second portion 28 which form an opening 30 within the second compartment 24. The opening 30 accommodates a baseball bat or softball bat B (shown in FIG. 4). The first portion 26 separates the first compartment 22 from the second compartment 24, as shown in FIG. 1A.

The second compartment 24 further includes a first, open, end 32 and a second, sealed, end 34 which is located opposite the first, open, end 32. A pair of hook and loop fasteners 38, 40 are located on the first portion 26 and the second portion 28, respectively, adjacent to the fourth end 18 as shown in FIG. 3.

The first portion 26 and the second portion 28 further form an extension 42 which extends from the fourth end 18 of the bag to the open end 32 of the second compartment 24.

Figure 3:
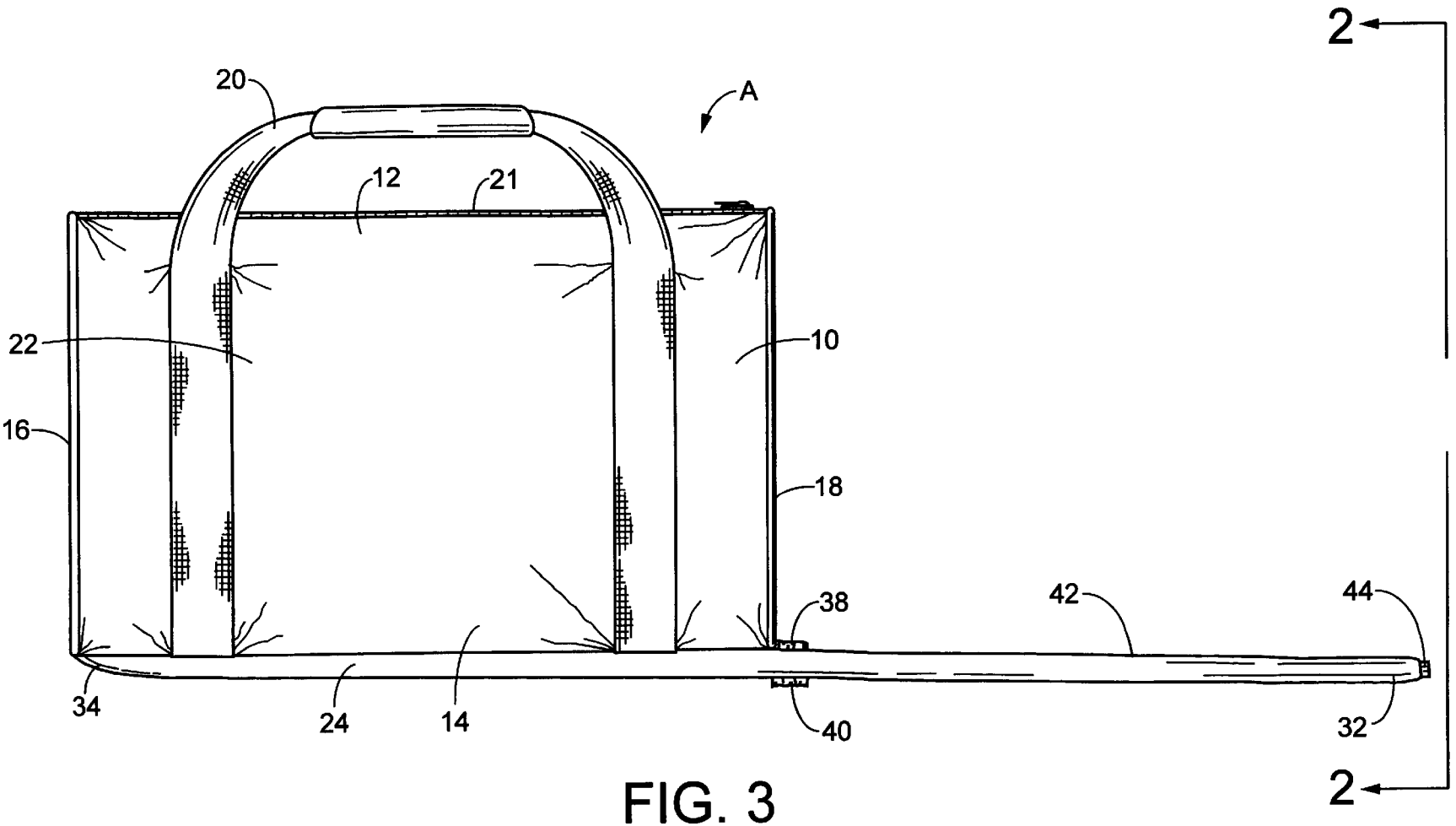
FIG. 3 is a side elevational view of the sporting equipment bag of FIG. 1 with the extendable portion in the extended position.
Figure 4:
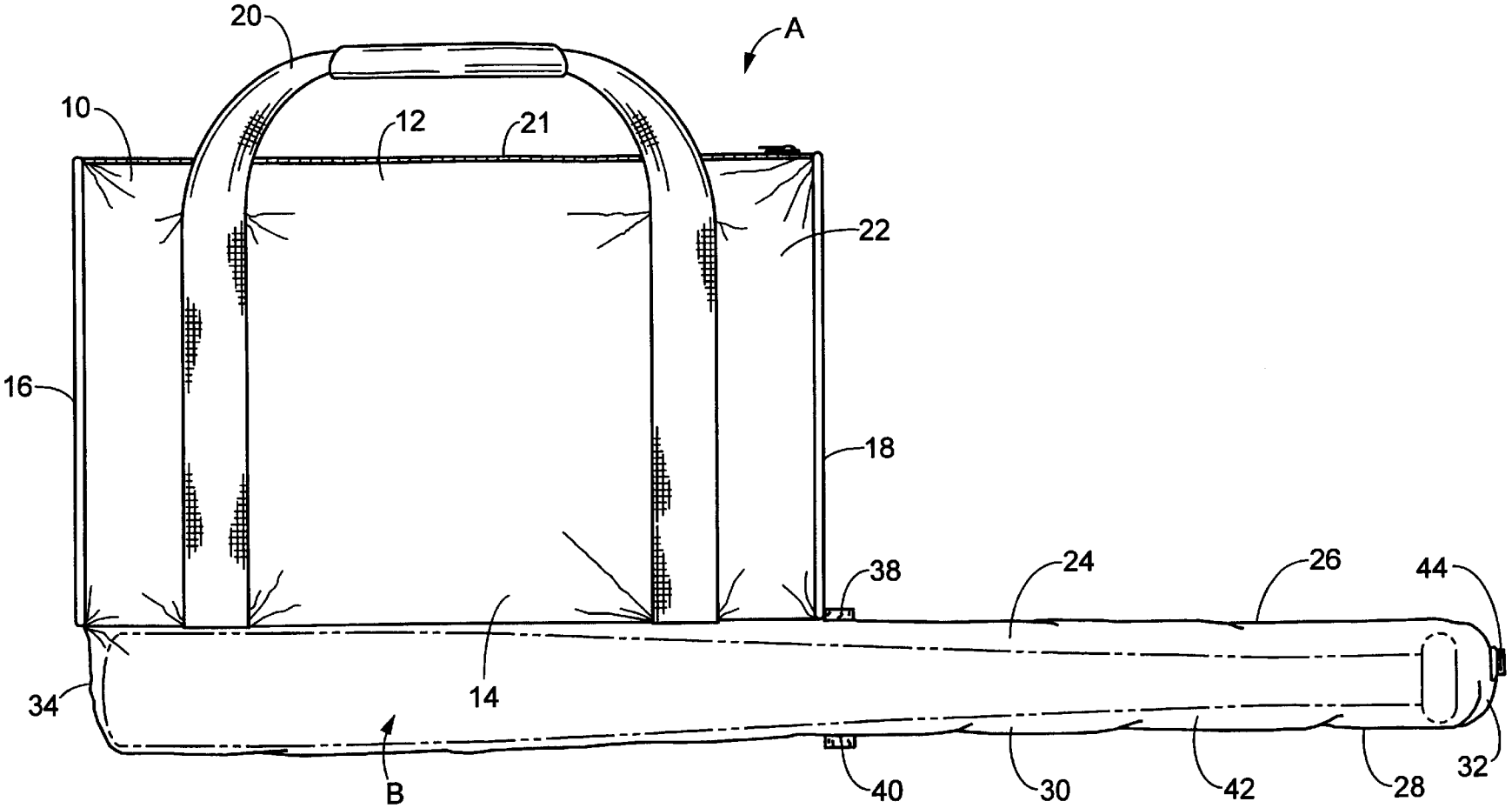
FIG. 4 is a side elevational view of the sporting equipment bag of FIG. 1 with the extendable portion in the extended position with a bat shown enclosed in cross-section.

In an extended position, the extension 42 extends away from the body 10 of the bag as shown in FIG. 3. A zipper 44 or other sealing means is provided at the open end 32. To insert a bat, the zipper 44 is unzipped and the bat is inserted into the opening 30 of the second compartment 24, as shown in FIG. 4. The bat is stored between the sealed end 34 and the open end 32. The zipper 44 is then zipped closed to prevent the bat from sliding out of the second compartment 24, as shown in FIG. 2 and FIG. 4.

When the extension 42 is not in use, it is folded or stuffed or telescoped into the second compartment 24 as shown in FIG. 1 and FIG. 1A. The open end 32 is also folded into the second compartment 24. When the extension 42 is fully inserted within the second compartment 24, the two hook and loop fasteners 38, 40 are removably attached to each other as shown in FIG. 1A. The hook and loop fasteners 38, 40 secure the extension 42 within the second compartment 24.

The feature of the extension 42 of the bag allows the user to store a bat in the second compartment 24 and store other sports equipment in the first compartment 22. The two separate compartments keep the equipment separate from the bats, thus avoiding damaging equipment or getting equipment dirty due to soiled bats or vice versa.

The extension 42 has a zippered opening 32 which allows the user to insert a bat into the bag second compartment 24 without having to go into the first or main compartment 22. This allows the user to quickly insert and remove bats without disturbing the equipment already stored in the bag.

The extension 42 may be folded or telescoped into the second compartment 24, thus allowing the user to use the bag as a typical equipment bag which is not used to store bats. The extension folds directly into the second compartment, and does not enter into or disturb the first compartment or its contents.

Although the invention is directed to an extension for baseball or softball bats, it could also be used for other types of sports equipment, such as tennis racquets, golf clubs, hockey sticks, etc.

The invention has been described with reference to a preferred embodiment. Obviously, alterations and modifications will occur to others upon a reading and understanding of this specification. It is intended to include all such modifications and alternations insofar as they come within the scope of the appended claims or the equivalents thereof.

Having thus described the preferred embodiment, the invention is now claimed:

1. A sporting equipment bag comprising:

a body having a first compartment, a first end, a second end, a third end and a fourth end, said first end and said second end are opposite to and generally parallel to each other, said third end and said fourth end are opposite to and generally parallel to each other, said first compartment is formed between said first end, second end, third end, and fourth end;

a second compartment which is located adjacent said first compartment, said second compartment has a first, open end, a second, sealed end, and a hollow section located between said first, open end, and said second, sealed end, said first, open end and said second, sealed end are located opposite each other;

wherein said first, open end extends beyond said body and is folded into said second compartment hollow section into a folded, stored position; and wherein said first, open end provides access to said second compartment separate from said first compartment.

2. The sporting equipment bag of claim 1 further comprising a handle attached to said body first end.

3. The sporting equipment bag of claim 1 further comprising a pair of hook and loop fasteners attached to said second compartment, wherein said hook and loop fasteners secure said second compartment into said folded, stored position.

4. The sporting equipment bag of claim 1 wherein said second compartment further comprises an extendable portion which extends between said body and said first, open end to receive a rod-shaped object and is telescoped within said second compartment hollow section into a folded, stored position.

5. The sporting equipment bag of claim 1 wherein said bag is made of flexible material.

6. The sporting equipment bag of claim 4 wherein said second compartment further comprises a first portion and a second portion, wherein said first portion and said second portion form said extendable portion and wherein said first portion separates said second compartment from said first compartment.

7. A sporting equipment bag comprising:

a body having a first compartment, a first end, a second end, a third end and a fourth end, said first end and said second end are opposite to and generally parallel to each other, said third end and said fourth end are opposite to and generally parallel to each other;

wherein said first compartment is formed between said first end, second end, third end and fourth end;

a second compartment which is located adjacent said first compartment;

wherein said second compartment has a first, open end, a second, sealed end, and a hollow section formed between said first, open end and said second, sealed end;

said first, open end provides access to said second compartment separate from said first compartment; and said second compartment further comprises an extendable portion which extends between said body and said first, open end to receive a rod-shaped object and which is telescoped within said second compartment hollow section into a folded, stored position.

8. The sporting equipment bag of claim 7 further comprising a handle attached to said first end.

9. The sporting equipment bag of claim 7 further comprising a pair of hook and loop fasteners attached to said second compartment to secure said second compartment in a folded, stored position.

10. The sporting equipment bag of claim 7 wherein said bag is made of flexible material.

11. The sporting equipment bag of claim 7 wherein said second compartment further comprises a first portion and a second portion, wherein said first portion and said second portion form said extendable portion, said first portion separates said second compartment from said first compartment.

* * * * *